US005406872A

United States Patent [19]

Conley, Jr. et al.

[11] Patent Number: 5,406,872

[45] Date of Patent: Apr. 18, 1995

[54] SIDE-BY-SIDE PROGRAMMABLE FEED SYSTEM

[75] Inventors: Ralph F. Conley, Jr., Miamisburg, Ohio; Young, James R., Gainesville, Ga.

[73] Assignee: MIM Industries, Inc., Miamisburg, Ohio

[21] Appl. No.: 34,872

[22] Filed: Mar. 19, 1993

Related U.S. Application Data

[63] Continuation-in-part of Ser. No. 920,977, Jul. 28, 1992.

[51] Int. Cl.[6] ..... B26D 7/00; D05B 37/04

[52] U.S. Cl. ..... 83/109; 83/202; 83/440; 83/636; 83/650; 83/902; 112/130

[58] Field of Search ..... 83/42, 272, 636, 650, 83/658, 694, 902, 440, 412, 109, 202; 226/109, 110; 112/130, 121.11, 153, 304; 225/34; 242/58.2, 58.3, 58.6, 181

[56] References Cited

U.S. PATENT DOCUMENTS

| | | | |
|---|---|---|---|
| 3,183,751 | 5/1965 | Trevaskis | 83/440 X |
| 4,011,975 | 3/1977 | Brown, Jr. | 226/109 X |
| 4,224,883 | 9/1980 | Biegler, Jr. et al. | 112/10 |
| 4,411,721 | 10/1983 | Wishart | 156/73.1 |
| 4,543,149 | 9/1985 | Abe et al. | 242/58.6 X |
| 4,708,072 | 11/1987 | Frye | 112/121.27 |
| 4,708,761 | 11/1987 | Taniguchi et al. | 156/554 X |
| 4,752,351 | 6/1988 | Lunt | 156/580.1 |
| 4,796,497 | 1/1989 | Morita | 83/42 X |
| 4,825,622 | 5/1989 | Nigg | 83/650 X |
| 4,838,137 | 6/1989 | Azuma | 83/42 |
| 4,856,444 | 8/1989 | Broeklehurst | 112/262.3 |
| 4,920,904 | 5/1990 | Frye | 112/262.1 |
| 4,936,177 | 6/1990 | Ozawa et al. | 83/636 X |
| 5,009,137 | 4/1991 | Dannatt | 83/650 X |
| 5,174,229 | 12/1992 | Adamski, Jr. et al. | 112/304 |
| 5,213,021 | 5/1993 | Goforth et al. | 83/578 X |
| 5,222,989 | 6/1993 | Hyca | 226/110 X |

*Primary Examiner*—Eugenia Jones
*Attorney, Agent, or Firm*—Biebel & French

[57] ABSTRACT

A side-by-side material feed system is provided for feeding two dissimilar strips of material. The material is fed along parallel feed paths by first and second material feeders which move the material toward respective cutters. The operation of the feeders and the cutters is controlled by a programmable controller which permits each of the material strips to be fed and cut to form pieces of predetermined length which may be removed by an operator or conveyed to a subsequent station for further processing. In a further embodiment of the invention, the feeders are movable relative to a work station comprising a cutter associated with a common feed path extending between the cutter and a sewing apparatus. As each of the feeders is aligned with the work station, a predetermined length of material may be cut off by the cutter and conveyed along the common feed path to the sewing station.

12 Claims, 5 Drawing Sheets

SIDE-BY-SIDE PROGRAMMABLE FEED SYSTEM

CROSS REFERENCE TO RELATED APPLICATION

This application is a continuation-in-part of co-owned application Ser. No. 07/920,977, filed Jul. 28, 1992, pending.

BACKGROUND OF THE INVENTION

1. Field of the Invention

This invention relates to a material feed system, and more particularly, it relates to a dual feed system having first and second feed paths and drive mechanisms for feeding two strips of material independently of each other to precise predetermined lengths.

2. Description of the Related Art

In the sewing industry, it is common to use feed mechanisms which continually feed out and cut strips of material to a predetermined length. The strips of material may either be used as they are cut by the feed system or they may be inventoried with similar pieces of material for later use. Such systems have been particularly useful for supplying fastener material such as hook or loop fastener strips prior to being sewn onto an article. For example, life jackets commonly use strips of hook or loop fastener material for permitting the ends of straps to be detachably fastened together for maintaining the life jacket in place on a person's body. During the production of such an article, it has been common to feed strips of a first material, such as the hook strips, for attachment to all points on the article requiring this particular material, and then replace the first material with a second different material, such as the material forming the loop strips, for subsequent operations attaching this material to the article.

The above-described operation has been found to be labor intensive in that the feed system must be alternately loaded with the different types of feed stock for forming the desired strips of material. In addition, if the material is inventoried in order to avoid repetitively changing the feed stock for the feed system, the step of producing the inventory of strips must be performed separately from the operation of attaching the strips to the article such that the strip production operation must be carefully regulated in order to correspond to the anticipated need for use during the attachment operation. This sequence of operations is not conducive to a fully automated system wherein material is fed from a continuous supply and during the same sequence of operations is subsequently attached to an article.

Another problem associated with present feed systems relates to an inability to accurately control the length of strips of material as they are fed toward a cutter. It has been common in prior art systems to use mechanical stops in order to regulate the cut length for strips of material. However, such systems have been subject to producing variations in the length of material produced, and it is desirable to have a system which accurately monitors the length of material as it is fed as well as provides means for changing the predetermined length that the material is fed out prior to actuation of the cutter.

SUMMARY OF THE INVENTION

Accordingly, there is a need for a feed system which is capable of producing plural lengths of material such that different types of material may be fed out and used upon demand. In addition, there is a need for such a system wherein the material may be fed out and cut to a predetermined length upon demand by an operator or, alternatively, fed to a device for attaching the strip to an article as part of a continuous automated operation.

In one aspect, this invention comprises an apparatus for feeding two continuous strips of material, said apparatus comprising means defining first and second feed paths; first and second feed means located along said first and second feed paths, respectively; programmable control means for controlling actuation of said feed means; and wherein said first and second feed means are operable to feed first and second strips of material along said first and second feed paths independently of each other such that strips of dissimilar material may be fed along said first and second paths.

In addition, first and second cutting means controlled by the controller may be provided located along the first and second feed paths for severing strips of material whereby individual material pieces of predetermined length are formed from the strips of material.

Further, means may be provided for conveying each material piece from the cutting means to a predetermined location in spaced relation to the cutting means. Thus, the means for conveying may be used to place the material pieces in a predetermined location within a sewing apparatus adjacent to the apparatus for feeding the two continuous strips of material.

An object of this invention is to provide an apparatus for feeding two dissimilar strips of material independently of each other.

Another object of this invention is to provide an apparatus for feeding two strips of material wherein the means for feeding the material are controlled by a common programmable control means wherein the parameters of the control means may be varied to alter the length of the material fed.

Yet another object of this invention is to provide an apparatus for feeding two continuous strips of material wherein the material is fed to a predetermined length under control of a programmable control means which actuates cutting means to sever individual pieces of material from the continuous strips.

Still another object of this invention is to provide an apparatus for feeding two continuous strips of material wherein the strips of material may be fed in an alternating manner to respective cutting means.

In a further embodiment of the invention, a dual feed apparatus is provided comprising a plurality of adjacent feeders for feeding a plurality of workpieces in a feed direction from an upstream location to a downstream location; a cutter for cutting the workpieces; and an actuator for selectively aligning the feeders with the cutter.

In another aspect of this embodiment, a control means is provided for energizing the actuator to selectively move one feeder at a time into alignment with the cutter wherein the feeders are mounted for movement in a sideways direction transverse to the feed direction.

These objects, and others, may be more readily understood in connection with the following specification, claims and drawings.

DESCRIPTION OF THE PREFERRED EMBODIMENT

Figure 1:
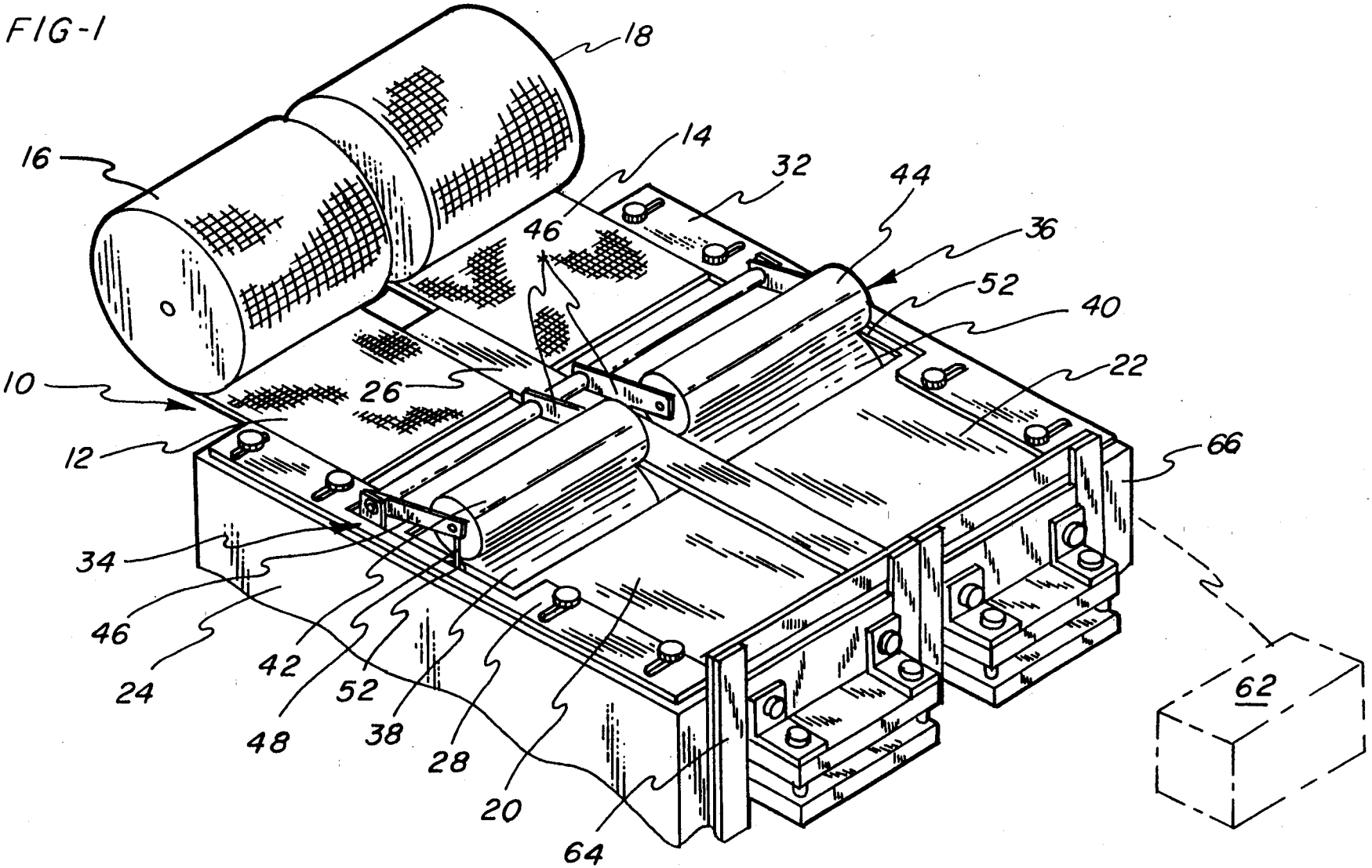
FIG. 1 is a perspective view of an embodiment of the side-by-side feeding system of the present invention.

Referring to FIG. 1, an apparatus 10 is illustrated in accordance with the present invention for feeding two continuous strips of material 12, 14 in side-by-side relationship to each other off of respective supply rolls 16, 18. The continuous strips of material 12, 14 are fed along substantially parallel paths 20, 22 defined on a common support table 24.

Figure 2:
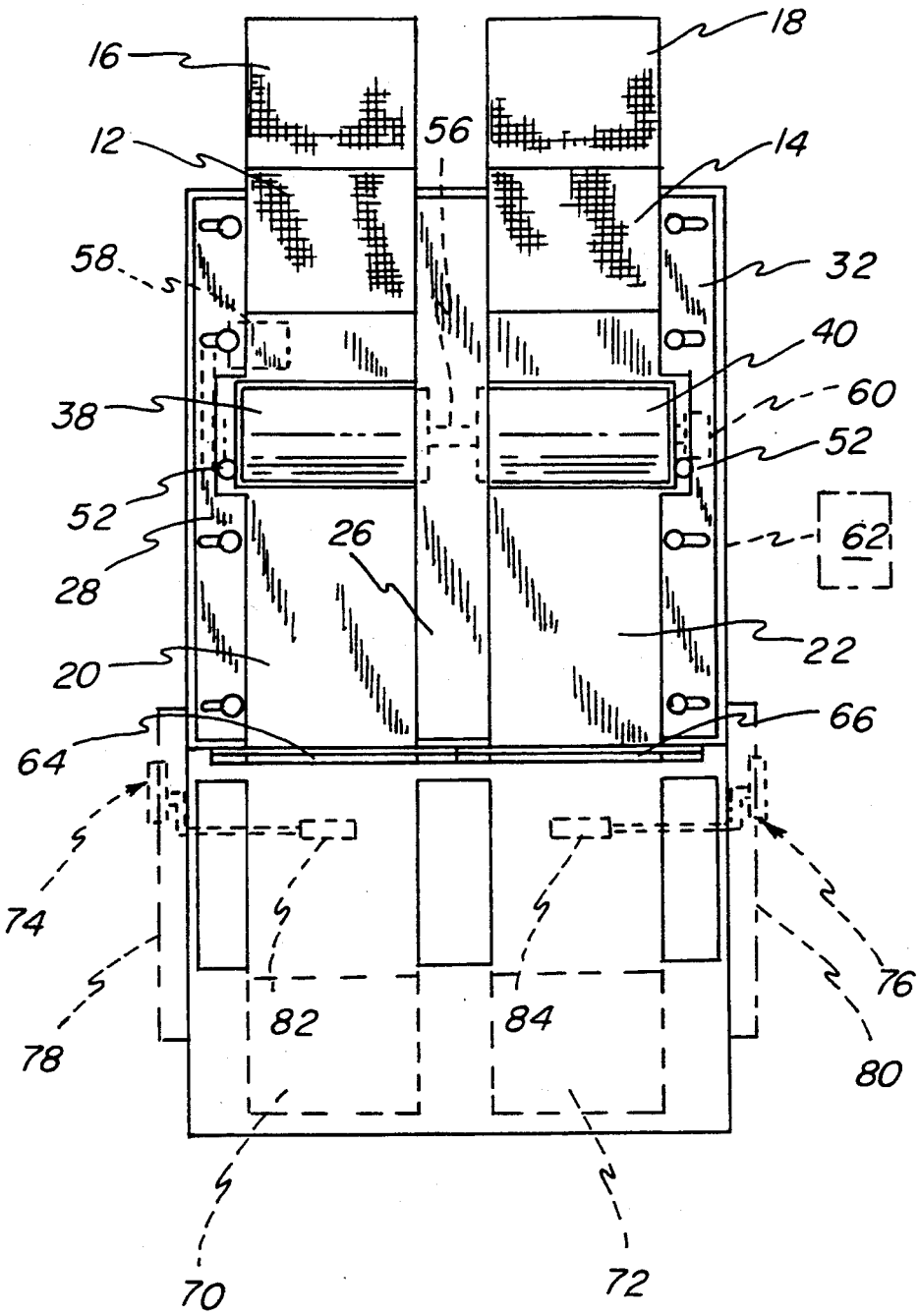
FIG. 2 is a plan view of the embodiment of FIG. 1 shown in combination with a system for conveying cut pieces to a sewing station, and in which the idler rolls of the feeding system have been removed for clarity.

As may be further seen in FIG. 2, the feed path 20 is defined by a fixed guide plate means 26 and adjustable guide plate means 28, and the second feed path 22 is defined by the fixed guide plate means 26 and an adjustable guide plate means 32. The adjustable guide plates 28 and 32 may be moved toward and away from the fixed guide plate means 26 whereby varying width strips of material may be accommodated in the guide paths 20, 22. In accordance with the present invention, it is contemplated that the adjustable guide plate means 28, 32 may be provided with a sufficient range of movement to accommodate strips varying in width from ½ inch to 2¼ inches.

As seen in FIG. 1, the material strips 12, 14 are drawn off the rolls 16, 18 and driven along the paths 20, 22 by first and second drive means 34, 36 which are located along the respective feed paths 20, 22. Each of the feed means 34, 36 include respective drive rollers 38, 40 and idler rolls 42, 44. The idler rolls 42, 44 are preferably supported on pivot arms 46 located at each end of the idler rolls 42, 44. The pivot arms 46 are pivotally attached to the table at one end and the idler rolls 42, 44 rotate on idler shafts (not shown) which pass through each of the idler rolls 42, 44 and engage an opposite end of the pivot arms 46. In addition, each of the assemblies formed by the pivot arms 46 and the idler rolls 42, 44 is attached to a respective actuation rod portion 48 of an actuator cylinder 52 whereby the idler rolls 42, 44 may be biased in pivotal movement toward and away from the drive rolls 38, 40.

As seen in FIG. 2, in which the pivot arms 46 and idler rolls 42, 44 have been removed to clearly show the underlying structure, the first and second drive rolls 38, 40 are mounted on a common shaft 56 which is driven by a motor 58 through a belt drive. In addition, an encoder 60 may be located on an opposite end of the shaft 56 whereby rotation of the shaft and associated drive rollers 38, 40 may be monitored by a programmable controller, depicted diagrammatically as 62. Thus, as the drive rollers 38, 40 are driven for rotation, the idler rolls 42, 44 may be biased toward and away from the drive rollers 38, 40 in order to selectively feed the material strips 12, 14 along the feed paths 20, 22. It should be noted that this is accomplished in accordance with a program run by the controller 62 and that the controller is connected to the actuator cylinders 52 for controlling actuation of the idler rolls 42, 44 in response to signals received from the encoder 60.

As the material strips 12, 14 are fed along the feed paths 20, 22 they pass through cutting means 64, 66 which are actuated by the controller 62 to sever the material 12, 14 in order to produce individual pieces of material of predetermined length. It should be noted that the cutting means 64, 66 may be any conventional cutter such as a Model No. 3000003C produced by MIM Industries, Inc. of Miamisburg, Ohio. Further, the actuating cylinders 52 and cutting means 64, 66 may be pneumatically actuated, and the pneumatic power for the cutting means 64, 66 may be provided via an actuation valve which is controlled by the controller 62 and which alternately actuates the first and second cutting means 64 and 66.

In operation of the apparatus 10, the controller 62 actuates the motor 58 to rotate the drive rolls 38, 40 for feeding material 12, 14 off of the stock rolls 16, 18. In a typical operation, it is common for the two continuous strips of material 12, 14 to be formed of dissimilar materials such as materials forming complementary strips of hook and loop fastener material. For example, strip 12 may be formed of hook material and strip 14 may be formed of looped material to fed for attachment to an article wherein the strips of hook and loop material will cooperate with each other to hold two detachable portions of the article together. The continuous strips of material 12, 14 are therefore preferably fed in an alternating manner and in order to accomplish this, the programmable controller 62 actuates the cylinders 52 and associated rollers 42, 44 to bias the rollers 42, 44 in an alternating manner down toward the drive rolls 38, 40 such that the material 12, 14 is alternately pressed into contact with the drive rolls 38, 40 and thereby driven forwardly along the feed paths 20, 22.

The encoder 60 monitors rotation of the shaft 56 to regulate the length to which either material strip 12 or 14 is fed, and upon the material strips 12, 14 being fed to predetermined lengths, as determined by parameters input into the programmable controller 62, the controller 62 will cause the idler rolls 42, 44 to be biased away from the drive rollers 38, 40 to terminate the feeding of the respective material strips 12, 14. It should be noted that the strips 12, 14 are fed independently of each other such that the controller 62 may be programmed to feed the material strips 12, 14 to different predetermined lengths, as required. Finally, after the required length of one of the material strips 12, 14 has been fed, the appropriate cutting means 64, 66 is actuated to cut the material strips 12, 14 to the required length whereby individual material pieces of predetermined length are formed from the strips of material 12, 14.

Referring to FIG. 2, the pieces of material cut from the strips 12, 14 may be further conveyed to sewing stations 70, 72, which are a depicted diagrammatically in the figure. Also depicted diagrammatically are a pair of conveying means 74, 76 for sliding the cut material pieces to the sewing stations 70, 72. The conveying means preferably run along rails depicted diagrammatically as 78, 80 with the position of the conveying means 74, 76 being controlled by stepper motors operating under the control of the programmable controller 62. The conveying means 74, 76 also include pawl members 82, 84 which are movable vertically into and out of contact with material pieces formed from the strips 12, 14. Thus, the conveying means 74, 76 may be used to convey material pieces from the feeding apparatus 10 to a precise predetermined location within a sewing station 70, 72. The precise location to which the material pieces are conveyed is preferably determined by the sensed length of the material pieces, as monitored by the encoder 60, to thereby provide for altering the parameters in the programming of the controller 62 such that the material pieces are accurately positioned with reference to the length fed prior to the cutting operation.

In a further use of the feed system 10, sensors (not shown) may be located adjacent to the cutting means 64, 66 to sense when a cut material piece has been removed. Upon sensing the removal of a material piece, the controller may actuate an appropriate cylinder 52 and associated idler roll 42, 44 to cooperate with the drive rollers 38, 40 to convey an additional length of the material 12, 14 into position to be cut to length.

Figure 3:
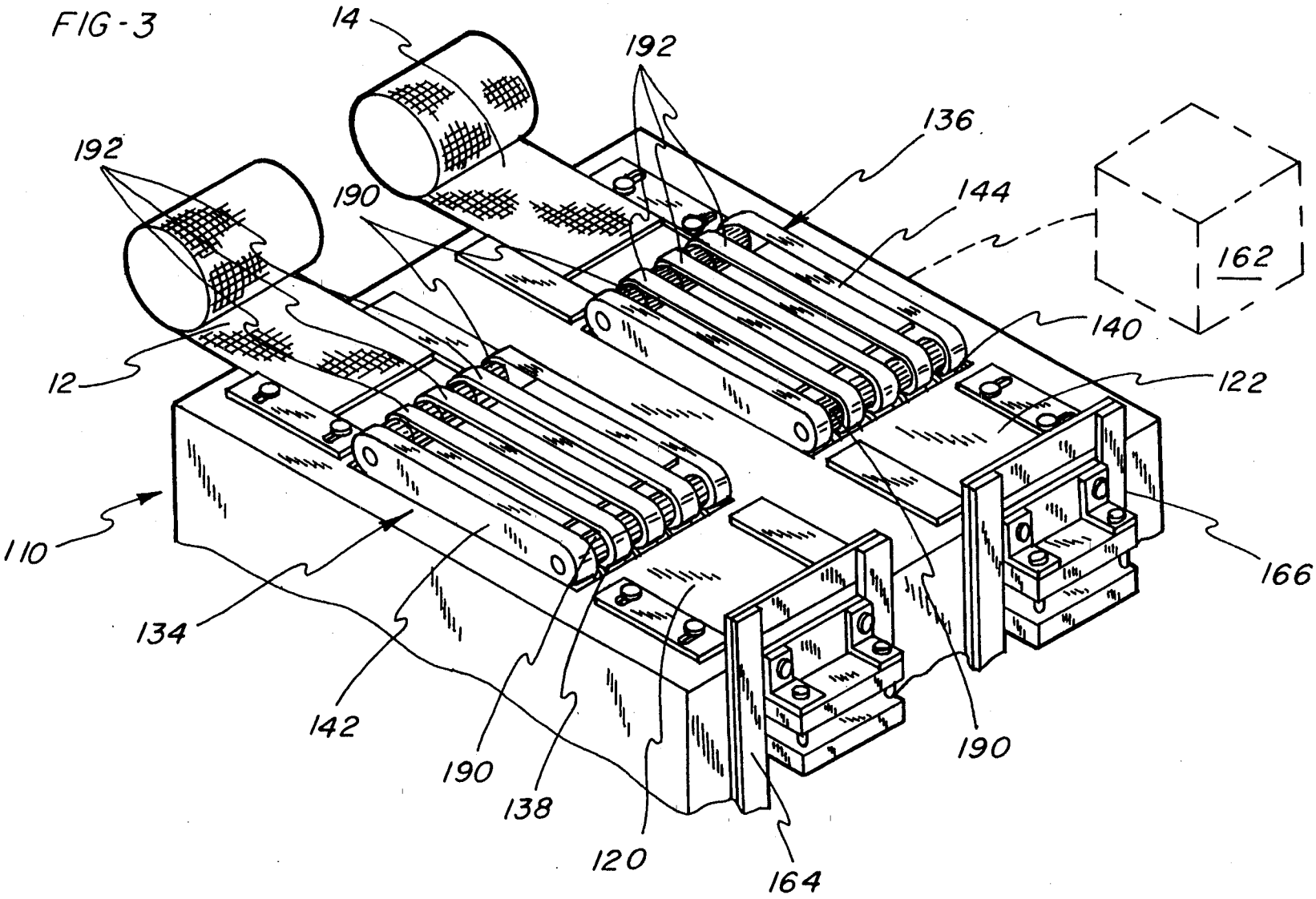
FIG. 3 is a perspective view of a second embodiment of the present invention in which a tractor or belt drive mechanism is illustrated.

Referring to FIG. 3, an alternative structure for a feed unit 110 is shown incorporating a tractor or belt drive mechanism for feeding the continuous material strips 12, 14 along feed paths 120, 122.

The feed mechanism includes first and second tractor drive units 134, 136. The first drive unit 134 includes lower and upper belt drives 138, 142 wherein each of the belt drives 138, 142 is provided with a drive motor (not shown). The second drive unit 136 is similarly provided with lower and upper belt drives 140, 144 having individual motor drives for each of the belt drives 140, 144. The belt drive units 138, 142 and 140, 144 have substantially similar structures including rotating support shafts 190 for supporting and driving a plurality of belts 192 wherein the belts form elongated conveyor surfaces for conveying the material strips 12, 14 through the feeder 110.

The first and second tractor feed units 134, 136 are operable independently of each other under control of the programmable controller 162 which activates the motors of the individual units 134, 136, as required. In addition, it should be noted that in this embodiment of the feed unit, the upper drive units 142, 144 remain in a stationary vertical position relative to the lower drive units 138, 140 such that the forward feed of material is controlled through control of the motors for the drive units.

Further, it should be noted that the tractor drive units 134, 136 provide increased control over the length the material pieces produced by the feed unit 110 in that the plurality of belts 192 substantially eliminate all slippage between the drive and the continuous strips of material 12, 14 which are fed through the unit to thus increase the precision at which the lengths are cut by cutting means 164, 166. In addition, it should be noted that although only three belts 192 have been shown for each of the feed units 134, 136 in the illustration of FIG. 3, any number of tractor belts 192 may be incorporated to accommodate the desired range of widths for the material stock being used in the feeder 110.

It should also be noted that conveying means and sewing apparatus similar to the structure shown in FIG. 2 may be used in combination with the feeder 110 in a manner similar to that described above with regard to FIG. 2.

From the above description of the side-by-side feed apparatus of the present invention, it should be apparent that this invention provides first and second feed means for feeding first and second strips of material along parallel feed paths, and control means coupled to the feed means to energize the feed means in a predetermined sequence and for predetermined periods of time to independently feed the first and second material strips to a downstream end of the apparatus.

Further, it should be apparent that the present invention permits the first strip of material to be fed under control of the programmable controller during a first time period to a first predetermined length which is different from a second predetermined time period for feeding a second predetermined length of the second strip of material. As the first and second strips of material are fed in a common direction toward cutting means, the programmable controller coordinates the feed of the first and second materials with the actuation of the first and second cutters in order to cut the strips of material into individual material pieces of predetermined length. Thus, the present invention is conducive to being used in applications where two dissimilar materials are required for a subsequent operation and wherein the materials must be supplied having dissimilar lengths.

In addition, the present system is conducive to readily changing the predetermined length of either individual material piece by entering the desired length parameter into the programmable controller via a keyboard associated with the controller.

Figure 4:
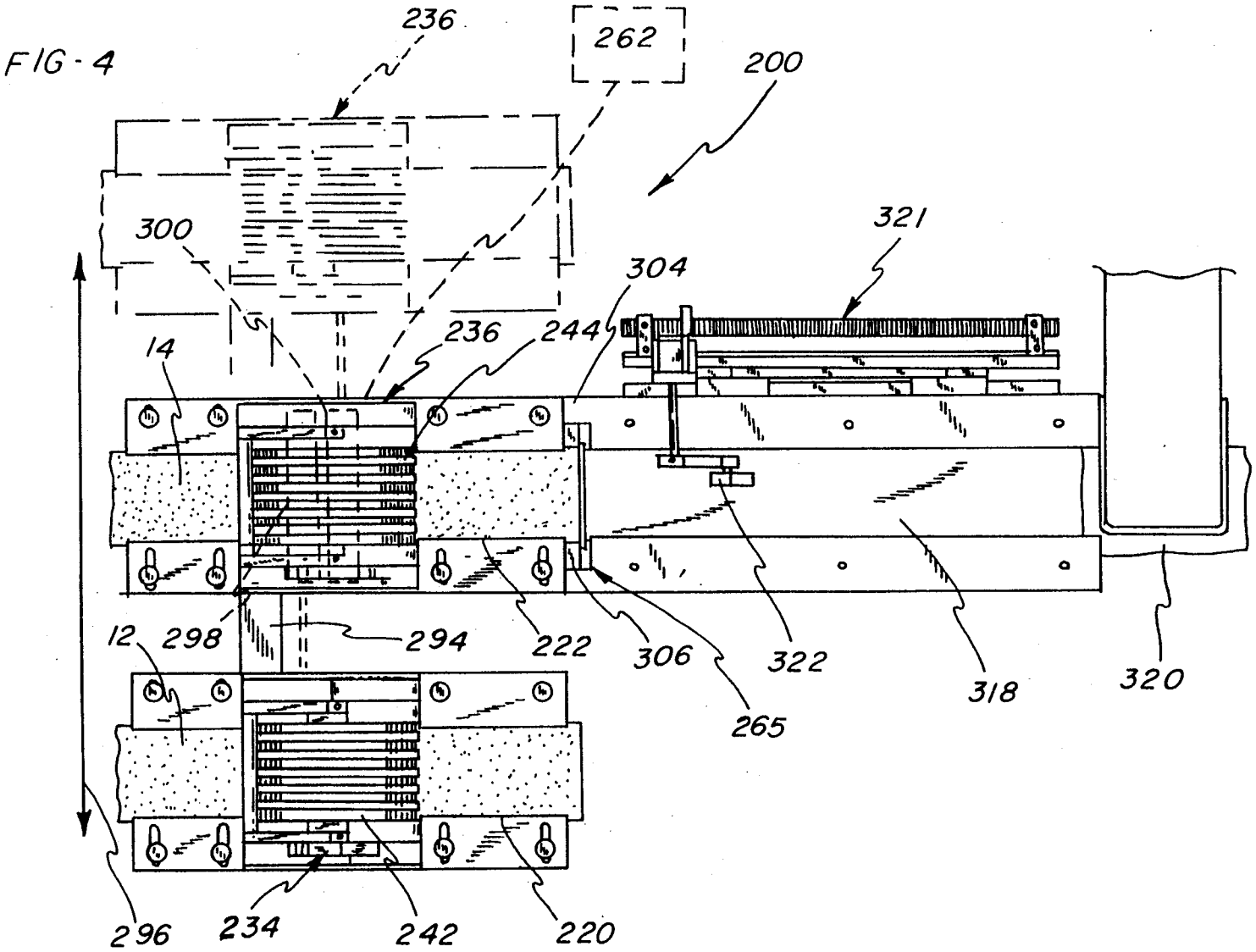
FIG. 4 is a plan view of a third embodiment of the present invention wherein the feed means are mounted for movement relative to a cutter.
Figure 5:
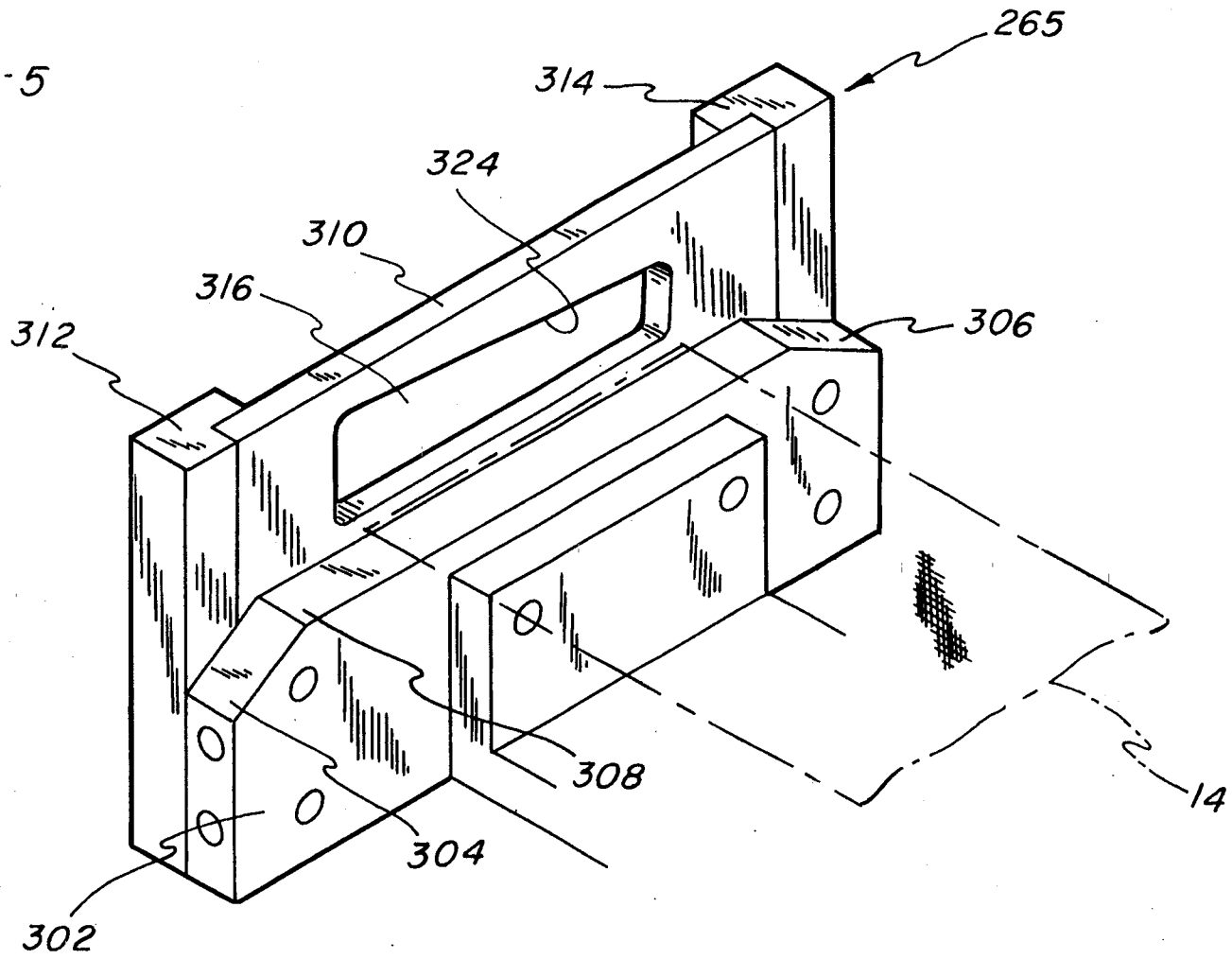
FIG. 5 is a perspective view of a cutter for use in the third embodiment of the invention.

In a third embodiment of the present invention, as shown in FIGS. 4 and 5, a system is disclosed which provides the above-described advantages for the previous embodiments and which further provides a common path for feeding the cut lengths of material to a sewing station. Referring to FIG. 4, the third embodiment comprises an apparatus 200 having first and second tractor drive feed units 234, 236 which are substantially similar to the tractor drive feed units 134, 136 of the embodiment of FIG. 3. Specifically, each of the feed units 234, 236 include a respective upper belt drive 242, 244 mounted over corresponding lower belt drives (not shown). As in the previous embodiments, the feed units 234, 236 are adapted to feed continuous material strips 12, 14 forwardly along respective feed paths 220, 222.

The present embodiment differs from the previous embodiment in that only a single cutter 265 is provided and the feed units 234, 236 are mounted on a shift table 294 for shifting movement in a direction transverse to the feed direction of the material 12, 14, as indicated by the arrow 296. The shift table 294 is mounted for sliding movement on top of a base frame (not shown) which also supports the cutter 265, and actuating means, depicted diagrammatically in the form of actuating cylinders 298, 300, are provided mounted to the base frame (not shown) for actuating the shift table 294 in opposing directions to provide reciprocating movement for the shift table 294 and feed units 234, 236. An alternative position for the feed unit 236 is depicted diagrammatically, and the feed unit 234 will assume a position adjacent to the cutter 265 when the feed unit 236 is in the diagrammatic position.

As is best illustrated by the length of material 12 lying in the feed path 220, a short length of the material 12, 14 extends beyond the feed paths 220, 222 after the material has been cut. As the feed units 234, 236 are shuttled back and forth to align with the cutter 265, the short length of material extending from the feed paths 220, 222 must be directed to alignment with the cutter 265. To this end, the cutter 265 is provided with a stationary blade 302 having beveled guide edges 304, 306 which extend up to a horizontal guide edge 308, as seen in FIG. 5.

As the feed paths 220, 222 are shuttled into alignment with the cutter 265, the respective beveled guide edges 306, 304 guide the short lengths of material extending forwardly from the guide paths 220, 222 upwardly onto the horizontal guide path 308 of the stationary blade 302.

The cutter 265 further includes a sliding blade 310 which is held in sliding contact with the stationary blade 302 by blade guides 312, 314 and which is actuated for downward cutting movement by an actuation cylinder (not shown). The sliding blade 310 includes an aperture 316 such that as the lengths of material 12, 14 are conveyed from the feed paths 220, 222 they will pass through the aperture 316 and onto a common feed path 318 for transfer to an attachment apparatus 320, such as a sewing head or a Velcro fusing head, by a pawl transfer mechanism 321 similar to that described with regard to the previous embodiments. The Velcro fusing head may be of the same type as that described in copending application Ser. No. 07/838,543, which is incorporated hereby by reference.

The upper edge of the aperture 316 defines a cutting edge 324 for cooperating with the edge of the horizontal guide surface 308 of the stationary blade 302 to cut the material 12, 14 in a direction transverse to the feed direction. It should be noted that the cutting edge 324 extends at an angle relative to the cutting edge of the stationary blade 302 such that the material 12, 14 is progressively cut in a direction transverse to the feed direction in order to ensure that a smooth cut is performed.

The above-described operations for the present embodiment may be controlled by a programmable controller 262 in the same manner as has been described with regard to the previous embodiments.

Thus, it should be apparent that the present embodiment provides an apparatus whereby plural feeders may be alternately positioned in alignment with a work station comprised of the cutter 265, common feed path 318 and sewing station 320 such that a predetermined length of material from each of the feeders may be fed and cut at the common feed path 318, and the material may be subsequently conveyed to a predetermined location within the sewing station 320.

While the forms of apparatus herein described constitute preferred embodiments of the invention, it is to be understood that the invention is not limited to these precise forms of apparatus and that changes may be made therein without departing from the scope of the invention which is defined by the appended claims.

What is claimed is:

1. A dual feed apparatus comprising:

a plurality of adjacent feeders, each of said plurality of adjacent feeders including a drive means and a supply stock of material wherein each said drive means draws material off a respective supply stock of material in a feed direction toward a work station;

an actuator for causing said plurality of adjacent feeders to move in a direction transverse to said feed direction and for selectively aligning at least one of said plurality of adjacent feeders with said work station so that said at least one of said plurality of adjacent feeders be energized to feed said material to said work station;

wherein each said drive means and supply stock of material is movable as a unit into alignment with said work station; and including a cutter located at said work station, said cutter including a stationary blade and a sliding blade, said stationary blade comprising a guide surface having a central horizontal portion and beveled portions extending upwardly from opposing ends of said stationary blade toward said central horizontal portion for guiding an end of said material upwardly onto said central portion during movement of each of said plurality of adjacent feeders into alignment with said cutter.

2. The dual feed apparatus as in claim 1 including control means coupled to said actuator, said cutter and each of said plurality of adjacent feeders, said control means energizing said actuator to selectively move one of said plurality of adjacent feeders at a time into alignment with said cutter, energizing said one of said plurality of adjacent feeders to move said material into said cutter and energizing said cutter to cut said material.

3. The dual feed apparatus as in claim 2 wherein said plurality of adjacent feeders is comprised of two feeders and said control means energizes said actuator to alternately align each of said plurality of adjacent feeders into alignment with said cutter and energizes each of said feeders to feed a predetermined length of said material through said cutter which is energized to cut said material.

4. The dual feed apparatus as in claim 1 wherein said sliding blade includes a cutting edge and said stationary blade includes a cutting edge, said cutting edges extending at an angle relative to each other whereby said cutting edges cooperate to progressively cut said material in a direction transverse to the feed direction.

5. The dual feed apparatus as in claim 4 wherein said sliding blade moves downwardly relative to said stationary blade to cut said material.

6. A material feed apparatus comprising:

at least one feeder for feeding a workpiece in a feed direction from an upstream location to a work station;

a cutter located at said work station for receiving the workpiece from said feeder, said cutter including a stationary blade and a sliding blade in operative sliding contact with said stationary blade wherein said stationary blade defines a guide surface for guiding an end of said workpiece into alignment with said cutter; and wherein said feeder is mounted for movement to move the workpiece in a direction transverse to the feed direction and said guide surface comprises a central horizontal portion and a beveled portion extending upwardly from an end of said stationary blade toward said central portion for guiding a forwardly extending end portion of said workpiece onto said central portion during said transverse movement.

7. The material feed apparatus as in claim 6 wherein said sliding blade and said stationary blade each define a cutting edge, said cutting edges extending at an angle relative to each other whereby said cutting edges cooperate to progressively cut the workpiece in a direction transverse to the feed direction.

8. The material feed apparatus as in claim 7 wherein said sliding blade moves downwardly relative to said stationary blade to cut the workpiece.

9. The material feed apparatus as in claim 8 wherein said sliding blade includes an aperture for receiving the workpiece therethrough and said cutting edge for said sliding blade is defined along an edge of said aperture.

10. The material feed apparatus as in claim 6 wherein a plurality of feeders are provided, each said feeder including a material supply for supplying material to be fed toward said cutter and said feeders being actuated for said transverse movement to position said feeders in alignment with said cutter.

11. The material feed apparatus as in claim 6 including a controller and conveying means wherein said controller actuates said feeder and said cutter to feed and cut, respectively, a predetermined length of the workpiece and said controller actuates said conveying means to convey the predetermined length of the workpiece to a predetermined location within an attachment apparatus for attaching the workpiece to an additional workpiece.

12. The material feed apparatus as in claim 6 wherein said feeder is movable in a horizontal direction substantially perpendicular to said feed direction.

* * * * *